US009875680B2

(12) United States Patent
Tan et al.

(10) Patent No.: US 9,875,680 B2
(45) Date of Patent: Jan. 23, 2018

(54) METHOD AND APPARATUS FOR GENERATION OF GRAY SCALE ADJUSTMENT VOLTAGE AND PANEL DRIVER CIRCUIT

(71) Applicant: SHENZHEN CHINA STAR OPTOELECTRONICS TECHNOLOGY CO., LTD., Shenzhen, Guangdong (CN)

(72) Inventors: Xiaoping Tan, Shenzhen (CN); Yong Zhang, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 184 days.

(21) Appl. No.: 14/240,352

(22) PCT Filed: Jan. 24, 2014

(86) PCT No.: PCT/CN2014/071306

§ 371 (c)(1),
(2) Date: Feb. 21, 2014

(87) PCT Pub. No.: WO2015/007084

PCT Pub. Date: Jan. 22, 2015

(65) Prior Publication Data

US 2015/0145903 A1 May 28, 2015

(30) Foreign Application Priority Data

Jul. 19, 2013 (CN) ..... 2013 1 0306800

(51) Int. Cl.
*G09G 3/20* (2006.01)
*G09G 3/36* (2006.01)

(52) U.S. Cl.
CPC ..... *G09G 3/2018* (2013.01); *G09G 3/3696* (2013.01); *G09G 2300/0828* (2013.01);
(Continued)

(58) Field of Classification Search
CPC combination set(s) only.
See application file for complete search history.

(56) References Cited

U.S. PATENT DOCUMENTS 5,805,126 A * 9/1998 Bassetti ..... G09G 3/3611 345/694
2002/0158882 A1 10/2002 Liaw et al. ..... 345/589
(Continued)

FOREIGN PATENT DOCUMENTS

CN 1897642 A 1/2007
CN 101083059 A 12/2007
(Continued)

OTHER PUBLICATIONS

Chinese Search Report issued Jan. 12, 2015, to the corresponding Chinese Application No. 2013103068001.
(Continued)

*Primary Examiner* — Robin Mishler
(74) *Attorney, Agent, or Firm* — Kim Winston LLP

(57) ABSTRACT

The present invention relates to a method and apparatus for generating gray scale adjustment voltages and a panel driver circuit using the same. With the method provided in the invention, said apparatus for generating gray scale adjustment voltages generates a plurality of gray-scale reference voltage groups at a given time interval $T_0$, and provides them for, such as a data driver circuit for adjusting gray scale of pictures by means of the reference gray-scale voltages, wherein values of the gray-scale reference voltages in each gray-scale reference voltage group are different from one another, and the time interval $T_0$ need to be less or equal to a quotient from the displaying time in each frame divided by the product of the number of pixels in the vertical direction of a display screen and the number of gray-scale reference voltage groups. The present invention can improve the rate for outputting the gray scale voltages by said gray scale adjustment voltages generation apparatus without modifying the original data driver circuit in the liquid crystal display, such that a displaying effect of higher-order is obtained and improvement in picture quality is accomplished. The present invention may be widely used in various image display devices.

2 Claims, 3 Drawing Sheets

(52) U.S. Cl.
CPC ..... *G09G 2300/0842* (2013.01); *G09G 2320/0276* (2013.01); *G09G 2320/0673* (2013.01)

(56) References Cited

U.S. PATENT DOCUMENTS

| | | | | |
|---|---|---|---|---|
| 2003/0137479 | A1 | 7/2003 | Yamasaki | 345/89 |
| 2007/0052641 | A1* | 3/2007 | Hagino | G09G 3/2011 345/89 |

FOREIGN PATENT DOCUMENTS

| | | | |
|---|---|---|---|
| CN | 101707050 | A | 5/2010 |
| CN | 101826307 | A | 9/2010 |
| CN | 102411914 | A | 4/2012 |
| CN | 103021365 | A | 4/2013 |
| CN | 103390393 | A | 11/2013 |
| EP | 1 845 513 | A2 | 10/2007 |
| JP | 2007-264104 | A | 10/2007 |
| KR | 10-0490047 | B1 | 5/2005 |

OTHER PUBLICATIONS

International Search Report dated May 14, 2014, issued to the corresponding International Application No. PCT/CN2014/071306.

* cited by examiner

METHOD AND APPARATUS FOR GENERATION OF GRAY SCALE ADJUSTMENT VOLTAGE AND PANEL DRIVER CIRCUIT

FIELD OF THE INVENTION

The present disclosure relates to the technical field of image display, and more particularly, to a method and apparatus for generation of gray scale adjustment voltage, which both are used for adjusting the gray scale of an image, and a panel driver circuit using the same.

BACKGROUND OF THE INVENTION

So far, a liquid crystal flat-panel display has been the one capable of comprehensively catching up with and surpassing color cathode ray tubes (CRT) in terms of comprehensive performance, such as brightness, contrast, power consumption, life, size and weight. It has become a mainstream product in the image display technical field nowadays due to its excellent characteristics, such as excellent performance, large-scale production, low cost of raw materials and broad development space. The basic operation principle of an existing liquid crystal display device is to adjust the liquid crystal transmittance of the backlight by applying a data voltage including image information to the liquid crystal and changing the twist degree of the liquid crystal, such that expected image display is realized. To obtain the image display with vivid color, besides controlling the color mixing quantity of red-green-blue primary color for each pixel point (the smallest area unit of image display), a display driver circuit of the liquid crystal display device also needs to implement fine adjustment on the brightness level of each pixel point, i.e., gray scale adjustment. The larger the quantity of gray scales is, the finer the effect of presented picture is. At present, particularly for the liquid crystal flat-panel display, the common gray scale adjustment approach is a digital-typed voltage-gray scale adjustment. In this approach, the quantity of the gray scales is determined by bits of an image data signal. Taking the 8 bit liquid crystal flat-panel display as an example, the image data signal is 8 bit, and $2^8=256$ gray scales may be presented. Further, for color displaying, as colors of each pixel point is constituted of red-green-blue primary color, the color change of each pixel point is thereby substantially caused by the gray scale change of red, green and blue sub pixels constituting the pixel point, such that a number of $2^8\times2^8\times2^8$, about 16.70 million, colors (chromatic number) may be presented. This means that when larger chromatic number is expected for achieving the better picture display effect, the bits of the image data signal need to be increased, and correspondingly, the quantity of the gray scales needs to be increased. In specific circuit implementation, a voltage signal for adjusting the gray scales (the value of which is merely a few volts) needs to be divided more finely, which undoubtedly increases certain difficulty in the design and manufacture of the display driver circuit. The most direct influence by this is that, when the bit of the image data signal is increased by one bit, the quantity of circuit elements in a data driver circuit for adjusting the gray scales in the display driver circuit needs to be doubled. This may lead to a series of problems, for example, the size of a chip is increased to improve the picture display quality and the investment cost is thereby raised.

SUMMARY OF THE INVENTION

With respect to above-mentioned problems, the objective of the present disclosure is to provide a method and apparatus for generation of gray scale adjustment voltage, which enables to improve picture quality without significantly increasing circuit elements, and a panel driver circuit using the same.

The gray scale adjustment voltage generation method provided in the present disclosure includes a step of generating k gray-scale reference voltage groups at a given time interval $T_0$, wherein $k\geq2$, and gray-scale reference voltage values in the gray-scale reference voltage groups are different from one another.

Further, in a preferred embodiment, $k=2^m$, in which $m\geq1$.

In a preferred embodiment, the given time interval $T_0$ satisfies the following condition:

$$T_0 \leq \frac{V_{frame}}{VT\times k}$$

In the above formula, $v_{frame}$ is the displaying time of each frame of picture. VT is the number of pixels in the vertical direction of a display screen, including virtual pixels at blank time, and k is the number of gray-scale reference voltage groups.

Moreover, in a preferred embodiment, the number of gray-scale reference voltages in each gray-scale reference voltage group is the same.

In addition, the present disclosure also provides a gray scale adjustment voltage generation device, which includes a programmable gamma module for generating gray scale adjustment voltages by using the method described above, wherein the programmable gamma module includes memories of which the number is at least the same as that number of the generated gray-scale reference voltage groups, and each memory is configured to store data for generating one group of gray-scale reference voltages.

In a preferred embodiment, besides the memories, the programmable gamma module also includes a logic interface, a register, a digital-to-analog conversion unit and a voltage output unit, wherein the logic interface is configured to receive digital signals for generating the gray-scale reference voltages and transmit the digital signals to the memories, and receive time sequence control signals and transmit the time sequence control signals to the register; the register is configured to access the memories under the control of the time sequence control signals, and pick out the digital signals in the memories and transmit the digital signals to the digital-to-analog conversion unit; the digital-to-analog conversion unit is configured to convert the digital signals transmitted by the register into analog signals and transmit the analog signals to the voltage output unit; and the voltage output unit is configured to amplify the analog signals transmitted by the digital-to-analog conversion unit and output as the gray-scale reference voltages.

Further, in a preferred embodiment, the voltage output unit includes operational amplifiers of the same number with that number of the memories, and each operational amplifier outputs one gray-scale reference voltage.

In addition, the present disclosure also provides a panel driver circuit, which includes above-described gray scale adjustment voltage generation device and a data driver circuit for receiving voltages output by the gray scale adjustment voltage generation device.

The present disclosure may improve the rate of outputting the gray-scale reference voltages by the gray scale adjustment voltage generation device without changing the original data driver circuit of the liquid crystal display, so as to obtain a display effect of higher-order and achieve the objective of improving the picture quality. The present disclosure may be widely used in various image display devices.

DETAILED DESCRIPTION OF THE EMBODIMENTS

To better describe the present disclosure, with an example of a display driver circuit of a liquid crystal flat-panel display of 256 gray scales, the operation principle of a digital-typed voltage-gray scale adjustment manner performed by a liquid crystal display device in the prior art is discussed in detail.

Figure 1:
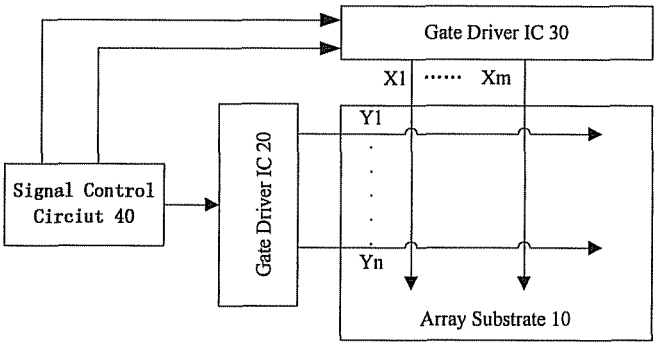
FIG. 1 is a schematic diagram of a display driver circuit of a liquid crystal flat-panel display in the prior art.

As shown in FIG. 1, in the display driver circuit of the liquid crystal flat-panel display of 256 gray scales, pixel points serving as the minimum unit for displaying are arranged at cross points of gate lines and data lines of an array substrate 10 in the form of an m×n array: the gate is connected with a gate line to receive a address selection switch signal transmitted by a gate driver integrated circuit (Gate Driver IC) 20 through the gate line; and the source is connected with a data line to receive a image data signal transmitted by a source driver IC 30 through the data line. Based on the address selection switch signals, the pixel points corresponding to the gate lines Y1 to Yn are turned on line by line, and when the pixel points of one certain line are turn on, the image data signals on the data lines X1 to Xm where the turned-on pixel points are connected are written into these pixel points.

Thus, color control and gray scale adjustment concerning imaging are executed by the source driver IC 30, and the main processes are to convert each 8 bit digital image data signal of red-blue-green primary color transmitted by a signal control circuit into an analog image data signal based on gray-scale reference voltages from a gray adjustment voltage generation apparatus, and to transmit the analog image data signal to its corresponding data line and write the analog image data signal into the pixel point when the pixel point is turn on.

Figure 2:
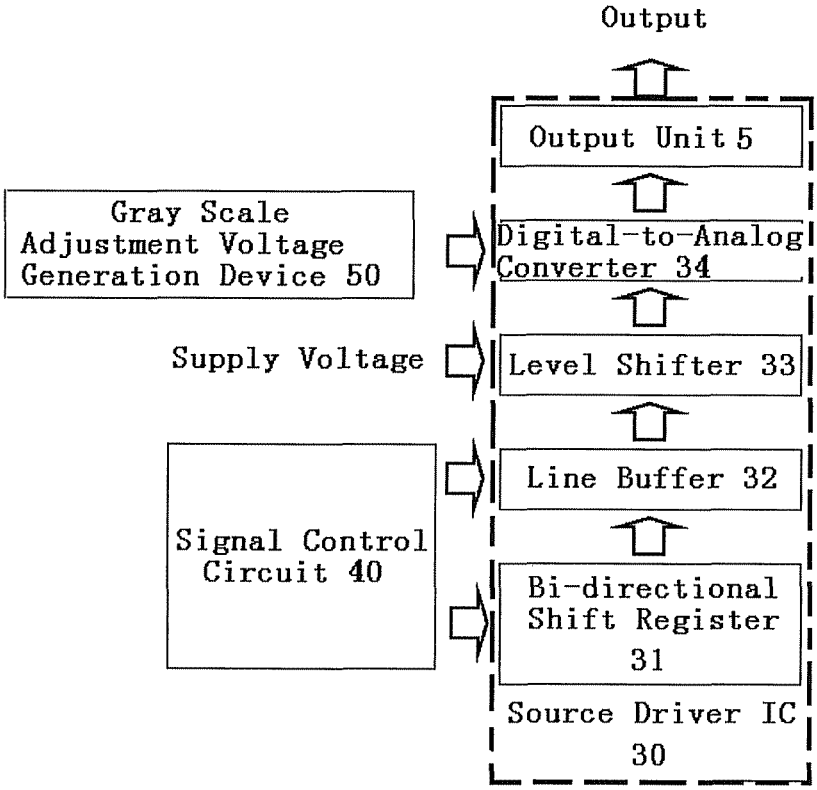
FIG. 2 is a schematic diagram of a data driver circuit of a liquid crystal flat-panel display in the prior art.

As shown in FIG. 2, the source driver IC 30 generally consists of a bi-directional shift register 31, a line buffer 32, a level shifter 33, a digital-to-analog converter (DAC) 34 and a output unit 35 (which is a buffer), wherein:

The bi-directional shift register 31 receives a timing signal transmitted by a signal control circuit 40, and controls the line buffer 32 to transmit the received digital image data signals transmitted by the signal control circuit 40, i.e., 8 bit digital image data signals of red-blue-green primary color D[7:0], to the DAC 34 in sequence based on the timing signal;

After the DAC 34 converts the digital image data signals into analog signals based on gray-scale voltages from a gray scale adjustment voltage generation device 50, the analog signals are transmitted to respective corresponding data lines through the output unit 35;

The level shifter 33 is used for converting the supply voltage of the liquid crystal display device into an appropriate operation voltage to supply to the DAC 34.

Figure 3:
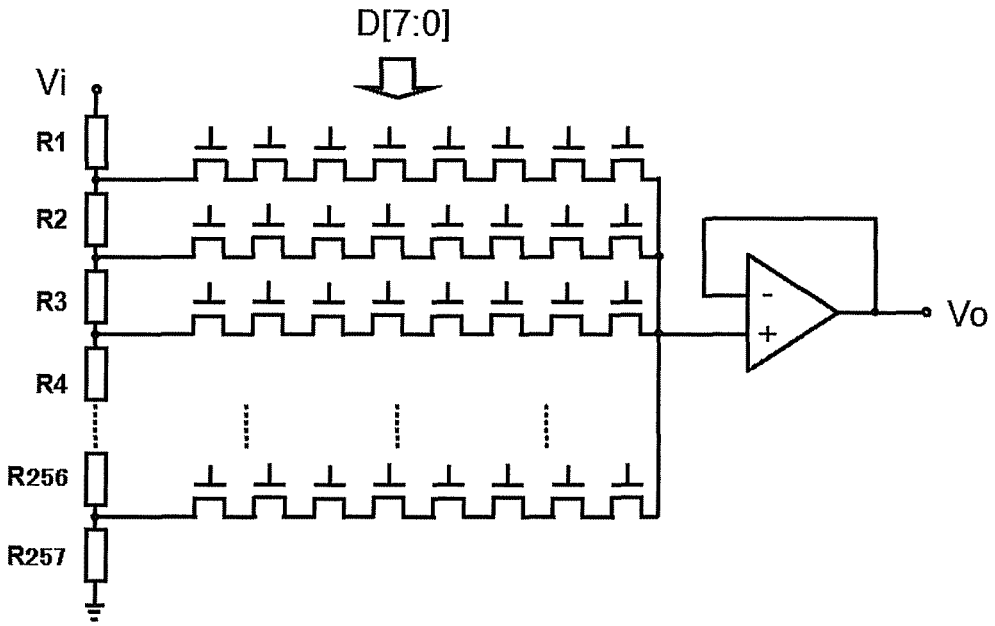
FIG. 3 is a schematic diagram of a resistor-string digital-to-analog converter in the prior art.

Here, as shown in FIG. 3, the DAC 34 preferably selects a R-string DAC for implementing a digital-typed voltage-gray scale adjustment manner. To achieve adjustment of 256 gray scales, 256+1=257 voltage dividing resistors are arranged in the DAC 34 to divide a gray-scale reference voltage Vi from the gray adjustment voltage generation device 50. Generally, the gray scale adjustment voltage generation device 50 may output a group of gray-scale reference voltages of a fixed number (generally 8 to 22) at one time, wherein the values of the gray-scale reference voltages are fixed and different from one another, and they form a gray-scale voltage curve together. The DAC 34 segments the gray-scale voltage curve to obtain 256 gray-scale voltages Vo for usage of gray scale adjustment, and each gray-scale voltage fixedly corresponds to one specific display brightness.

Figure 4:
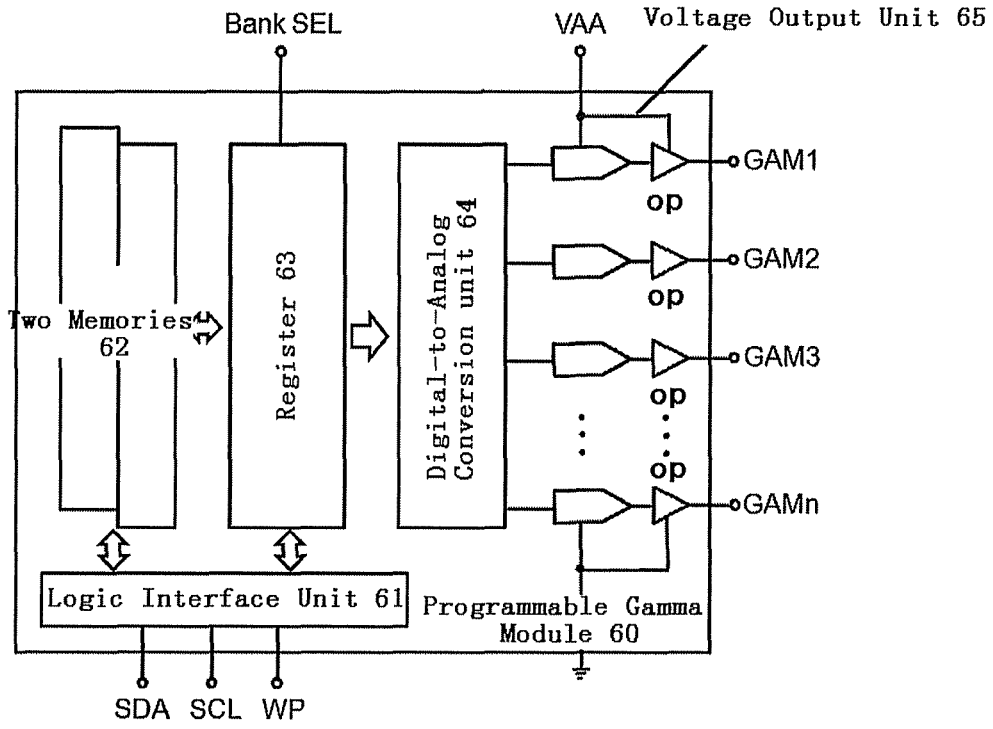
FIG. 4 is a schematic diagram of a programmable gamma module in the prior art.

In the prior art, the above-described gray scale adjustment voltage generation device 50 for providing the gray-scale reference voltages may include a programmable gamma module 60 as shown in FIG. 4, and the module generally includes a logic interface unit 61, memories 62, a register 63, a digital-to-analog conversion unit 64 and a voltage output unit 65;

The logic interface unit 61 is configured to receive digital signals (generally, serial data (SDA)) for generating target gray-scale reference voltages, and transmit it to the memories 62; receive time sequence control signals (generally, serial clock signals (SCS)) for controlling operation of the programmable gamma module, and transmit it to the register 63; and receive write enabling signals (WP), wherein the digital signals for generating the target gray-scale reference voltages and the time sequence control signals for controlling operation of the programmable gamma module may be predetermined by programming;

The memories 62 are configured to receive and store the digital signals for generating the target gray-scale reference voltages, which are transmitted by the logic interface unit 61, wherein one of memories 62 stores the digital signals for merely generating one group of target gray-scale reference voltages. Generally, gray-scale voltage curves used in 2D displaying is inconsistent with that of 3D displaying, thus two memories are needed.

Figure 5:
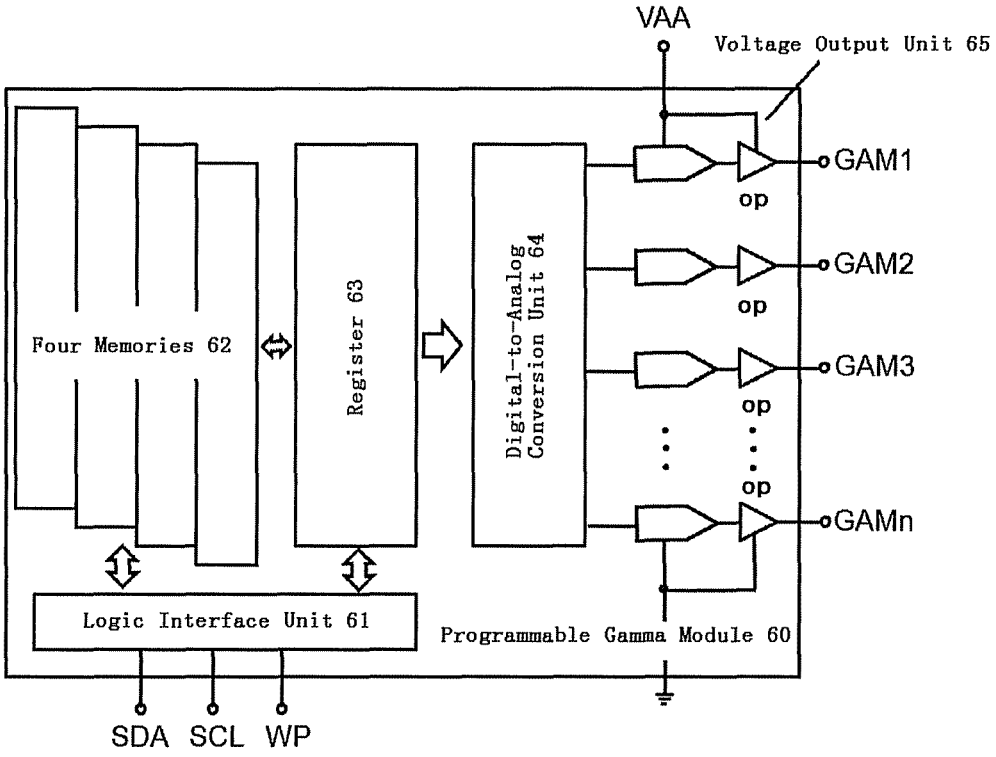
FIG. 5 is a schematic diagram of a programmable gamma module in an example of the present disclosure.

The register 63 is configured to access the memories 62 under the control of the time sequence control signals transmitted by the logic interface unit 61, and pick out the digital signals in the memories 62 and transmit it to the digital-to-analog conversion unit 64;

The digital-to-analog conversion unit 64 is configured to convert the digital signals transmitted by the register 63 into analog signals and transmit the analog signals to the voltage output unit 65;

The voltage output unit 65 is configured to amplify the analog signals transmitted by the digital-to-analog conversion unit 64 and output the amplified analog signals as output of the target gray-scale reference voltages. Herein, the voltage output unit 65 may include operational amplifiers (OP) with a number equals to that number of the memories, and each OP outputs only one gray-scale reference voltage, so the number of the OP determines the number of gray-scale reference voltages in one group (GAM1, GAM2 . . . GAMn). VAA in FIG. 5 is the operation voltage of the voltage output unit 65.

As mentioned in the background of the invention, when the bits of the image data signals are increased by one bit, the quantity of circuit elements in the data driver circuit for adjusting gray scales in the display driver circuit needs to be doubled, such that a series of problems, such as increase of the size of a chip and rise of the production cost are caused. Therefore, the present disclosure provides a new solution from another perspective: displaying effect of higher-order may be obtained without changing the original data driver circuit but by improving the rate of outputting the gray-scale reference voltages from the gray adjustment voltage generation device, such that the objective of improving the picture quality is achieved. That is, within the original time of outputting a group of gray-scale reference voltages, a plurality of groups of gray-scale reference voltages are output, and values of the gray-scale reference voltages in one gray-scale reference voltage group are different from that of other groups.

An example is taken by the realization of the displaying effect of 10 bit based on an 8 bit liquid crystal flat-panel display, the gray scale adjustment voltage generation device needs to output at least $2^{(10-8)}$ groups of gray-scale reference voltages within the original time of outputting one group of gray-scale reference voltages. For the gray scale adjustment voltage generation device using the programmable gamma module, the above-mentioned objective may be achieved by increasing the number of memories in the programmable gamma module. As shown in FIG. 5, the number of the memories in the existing programmable gamma module is increased to be at least equal to the number of the generated gray-scale reference voltage groups, and here is four. As each memory merely stores the serial data for generating one group of gray-scale reference voltages, and which serial data is generally the one corresponding to 8 to 22 gray-scale reference voltages, having the relative low data volume, thus the increased cost may be ignored. Then, by adjusting the serial clock signals for controlling the operation of programmable gamma module, the register of the programmable gamma module is configured to successively access four memories within the original time for accessing one memory. As mentioned above, due to the number of circuit hardware, such as the operational amplifiers in the programmable gamma module, the number of gray-scale reference voltages in each gray-scale reference voltage group is constant. If the programmable gamma module originally would output 10 gray-scale reference voltages in one group, then 40 gray-scale reference voltages in four groups may be output now within the same time, i.e., four gray-scale voltage curves are determined for performing division by the digital-to-analog conversion unit of the 8 bit data driver circuit, and the quantity of the divided gray-scale voltages is increased to four times of the original one.

Specifically, the gray scale adjustment voltage generation device continually outputs four groups of gray-scale reference voltages according to the following manner:

At a $t_1$ moment, outputting the first group of gray-scale reference voltages;

At a $t_2$ moment, outputting the second group of gray-scale reference voltages;

At a $t_3$ moment, outputting the third group of gray-scale reference voltages;

At a $t_4$ moment, outputting the fourth group of gray-scale reference voltages;

. . .

At a $t_{i+1}$ moment, outputting the first group of gray-scale reference voltages;

At a $t_{i+2}$ moment, outputting the second group of gray-scale reference voltages;

At a $t_{i+3}$ moment, outputting the third group of gray-scale reference voltages;

At a $t_{i+4}$ moment, outputting the fourth group of gray-scale reference voltages.

Wherein the values of the gray-scale reference voltages in each gray-scale reference voltage group may be predetermined by programming. Generally, the value range of each gray-scale voltage curve is the same, and the specific value of each gray-scale reference voltage may be set by means of optical verification. Briefly, in consideration of the smoothness of a gray-scale voltage curve, it is supposed that the gray-scale reference voltage GAM1 is 2V based on gray-scale GAMMA=2.2, then the GAM1s in the four groups of gray-scale voltages may be 1.85V, 1.95V, 2.05V and 2.15V respectively from a perspective that the gray-scale voltages among the four continuous groups have low difference and continuation and an average value of 2V, and the like.

From the above-described examples, it could be derived that, to realize the displaying effect of (n+m) bit based on a n bit data driver circuit, the gray-scale reference voltage groups with a number of k may be generated at a given time interval $T_0$, wherein $k \geq 2$, preferably, $k=2^m$, $m \geq 1$. The values of gray-scale reference voltages in each gray-scale reference voltage group are different from one another, and the time interval $T_0$ needs to satisfy the following condition:

$$T_0 \leq \frac{V_{frame}}{VT \times k}$$

In the above formula, $v_{frame}$ is the displaying time of each frame of picture, VT is the number of pixels in the vertical direction of a display screen, and the pixels include virtual pixels at blank time; for example, for one type display screen with the resolution of 1366×768, the VT of the display screen is not 768, but 800; and k is the number of gray-scale reference voltage groups Correspondingly, for the gray scale adjustment voltage generation device including the programmable gamma module, the programmable gamma module therein needs to be provided with memories of at least in the same number as the generated gray-scale reference voltage groups, and each memory is configured to store data for generating one group of gray-scale reference voltages.

The present disclosure also provides a panel driver circuit which includes the above-described gray scale adjustment voltage generation device and a data driver circuit matched with the gray scale adjustment voltage generation device.

The present disclosure also provides a display panel which includes the above-described panel driver circuit.

It should be noted that, the examples described above constitute a portion, but not all, of the embodiments of the present disclosure, and they are merely used for explaining the present disclosure. All other embodiments, obtained by those of ordinary skilled in the art based on the present example without any creative effort, fall into the protection scope of the present disclosure.

What is claimed is:

1. A method for generating gray scale adjustment voltage, including the step of generating k gray-scale reference voltage groups at a given time interval $T_0$ by increasing memories in quantity in a programmable gamma module of a gray scale adjustment voltage generation device, wherein $k \geq 2$, and gray-scale reference voltage values in the gray-scale reference voltage groups are different from one another, wherein, the given time interval $T_0$ satisfies the following condition:

$$T_0 \leq \frac{V_{frame}}{VT \times k}$$

wherein, $v_{frame}$ is the displaying time of each frame of picture, and VT is the number of pixels in the vertical direction of a display screen, including virtual pixels at blank time, VT>1 wherein, $k=2^m$, in which $m \geq 1$.

2. The method of claim 1, wherein the number of gray-scale reference voltages in each gray-scale reference voltage group is the same.

* * * * *